United States Patent [19]

Rosan, Jr.

[11] 4,236,495

[45] Dec. 2, 1980

[54] SELF LOCKING VALVE SEAT INSERT

[75] Inventor: José Rosán, Jr., Newport Beach, Calif.

[73] Assignee: Rosan, Inc., Newport Beach, Calif.

[21] Appl. No.: 950,973

[22] Filed: Oct. 13, 1978

[51] Int. Cl.[3] ..... F01L 3/22
[52] U.S. Cl. ..... 123/188 S; 29/156.7 A
[58] Field of Search ..... 123/188 S; 29/156.7 A

[56] References Cited

U.S. PATENT DOCUMENTS

| | | | |
|---|---|---|---|
| 2,017,154 | 10/1935 | Larkin | 29/156.7 A |
| 2,672,856 | 3/1954 | Wagner | 123/188 S |
| 3,868,953 | 3/1975 | Roll | 123/188 S |

*Primary Examiner*—Ronald H. Lazarus

[57] ABSTRACT

A valve seat insert for installation in cylinder heads of internal combustion engines which includes a pilot flange, an annular groove and a serrated locking flange by which the valve seat insert is locked into the cylinder head.

2 Claims, 3 Drawing Figures

SELF LOCKING VALVE SEAT INSERT

BACKGROUND OF THE INVENTION

1. Field of the Invention

The present invention relates to valve seats and particularly to self locking valve seats for use in internal combustion engines.

2. Description of the Prior Art

It has been common knowledge in the art that successful performance of a valve seat insert requires that there be intimate contact with the surrounding engine material so that adequate heat transfer may occur between the insert and the engine.

The problem of heat transfer is also involved with the problem of securely fastening the valve seat insert in the cylinder head of the engine.

As a means to improve the economy of the Otto type internal combustion engine, auto manufacturers have attempted to switch from cast iron to aluminum block and/or aluminum head engines. This switch has accentuated the problems associated with heat transfer and securely fastening valve seats in the cylinder heads.

A number of solutions have been tried in the past with limited success. Valve seats which are pressed into counterbores and then locked in place with various devices have been used. These have not proved entirely satisfactory because of heat transfer problems, resulting from the buildup of corrosion and carbon deposits around the insert and its fastening device.

Self tapping threads have been used on valve seat inserts as in U.S. Pat. No. 3,868,953 to overcome heat transfer and secure fastening problems. While partially solving those problems this method has introduced new problems of alignment and cost of manufacture. Furthermore, replacement of the insert with the self-cutting thread sometimes results in a loose valve seat since the new insert may not fit tightly into the threadways formed by the previously used valve seat insert.

The method currently used for insertion of valve seat inserts is to lower the temperature of a machined insert by immersion in liquid nitrogen. Then heat the cylinder head to expand the machined opening and then force the insert into the opening.

When the insert and cylinder head reach ambient temperature a tight fit results with good heat transfer characteristics. However, this method is expensive since it involves rigid manufacturing tolerances and the use of cryogenic equipment and the handling of liquid nitrogen. There is also a safety hazard involved in handling liquid nitrogen as part of a large production scale operation.

Also, while this cryogenic procedure has proved satisfactory for initial engine production operations, it does not solve the problem of replacing valve seats in the field.

SUMMARY OF THE INVENTION

It is an object therefore of this invention to provide a simple economical valve seat insert capable of easy, inexpensive insertion in cylinder heads of internal combustion engines.

It is an object of this invention to provide a valve seat insert, which is self locking into intimate contact with the surrounding material of the cylinder head.

It is still another object of this invention to provide a valve seat insert with improved heat transfer characteristics.

It is a further object of this invention to provide a self locking valve seat insert that can be removed and replaced in the field with common tools available at most service garages.

The present invention accomplishes these objects and others by providing a valve seat insert with a first pilot flange to guide the insert into a prebored hole in the cylinder head into which it snuggly fits. A locking flange of greater diameter than the pilot flange and the prebored hole contains longitudinal serrations around the circumference thereof and a cutting edge. One shoulder of the locking flange and a shoulder of the pilot flange define an annular groove into which displaced metal is packed.

The valve seat insert is forced into the cylinder head the cutting edge of the serrations swaging metal from the sides of the prebored hole and packing the bits and shaving into the annular groove preventing axial movement of the insert when in place. The serrations around the circumference also cut grooves into the walls of the cylinder head and are locked into intimate contact with the cylinder head in these grooves, preventing rotational movement and insuring maximum heat transfer between the valve seat insert and the cylinder head.

From the following description taken in conjunction with the accompanying drawings, the objects, features and advantages of this invention will become apparent.

DESCRIPTION OF THE PREFERRED EMBODIMENT

Figure 1:
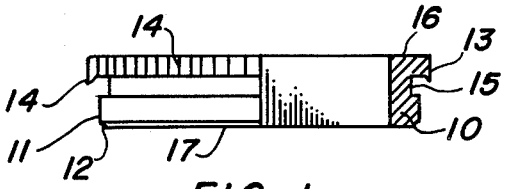
FIG. 1 is a partial cross-section side plan view of the self locking valve seat.
Figure 2:
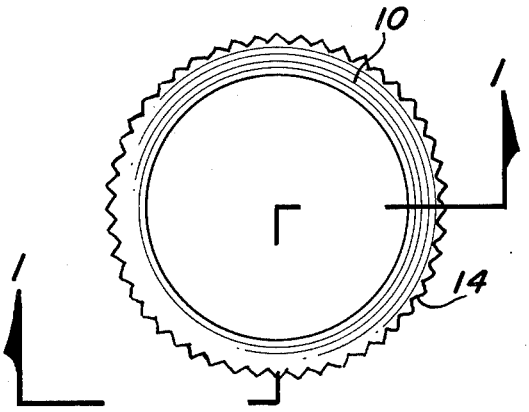
FIG. 2 is a top plan view of the self locking valve seat.
Figure 3:
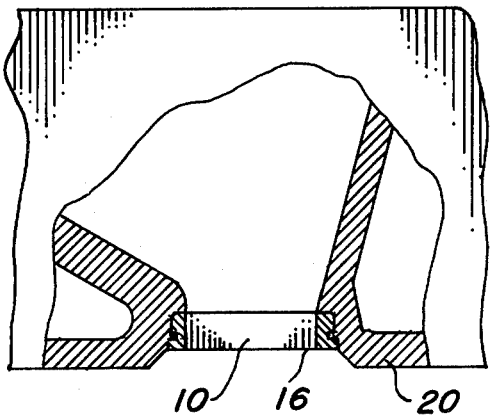
FIG. 3 is a partially sectional view of a cylinder head with the self locking fastener in place.

Referring now to the drawings for an understanding of the invention, particularly to the embodiment in FIG. 1 and 2. A cylindrical ring 10 has a valve seat formed in its upper face 16. Pilot flange 12 designed to guide the ring 10 into a prebored hole in cylinder head 20 is formed in the lower portion of ring 10.

Lead edge 12 is beveled towards the lower face 17 to facilitate entry into the prebored hole. A locking flange 13 greater in diameter than pilot flange 10 has a cutting shoulder 14 opposite the valve seat face, the purpose of which will be clearly described below.

The circumference of locking flange 13 is processed to form longitudinal serrations 14. Between pilot flange 11 and locking flange 13 an annular groove 15 is formed by the shoulders of the two flanges. The self locking valve seat is installed as by first drilling a straight sided hole in the cylinder head 20 with a diameter adopted to snuggly accept the pilot flange 11. Fitting 10 is placed above the prebored hole. Pilot flange 11 is inserted in the hole. Insertion pressure is then applied to valve seat face 16. Cutting shoulder 14 displaces metal shavings and chips (not shown) into annular groove 15. Serrations 13 cut cooperating grooves in cylinder head 20 locking the valve seat 10 in place preventing radial movement. The shavings and chips cut away from the cylinder head 20 which are displaced and packed into annular groove 15 locking the fitting into position and preventing axial movement outward. Valve seats utilizing the device of this invention have resisted push out forces in excess of 15,000 pounds which exceeds operating engine pressures.

Thus it can be seen that the above device, although simple in construction, fills a long established need and surprisingly provides a positively metal-to-metal lock resistant to high push out pressures. The metal-to-metal lock also assures efficient heat transfer from valve seat to cylinder wall. The above described self locking valve seat insert can be easily replaced in the event of valve seat failure. The defective valve seat insert 10 is pushed out. A new self locking valve seat insert is then pressed in place to a depth greater by the width of the annular grooves 15. This will provide sufficient shavings and chips to pack in said groove 15 to lock the valve seat insert in place so as to resist axial push out. The serrations 13 will mesh with the preformed grooves preventing radial movement. The tight metal-to-metal lock will insure excellent heat transfer between the valve seat insert and the cylinder head.

While only one embodiment of the invention has been shown and described in detail it is apparent that the invention may be incorporated into valve seat inserts having various different forms and sizes.

It is also apparent to those skilled in the art that many changes and modifications may be made in the illustrated embodiment without departing from the scope of the invention as described in the specifications, drawings and claims.

I claim:

1. A cylinder head and valve seat insert in combination comprising;

a cylinder head of material softer than the valve seat insert;

a valve seat insert for installation therein which includes a pilot flange, a locking flange means containing a cutting edge on its lower face and the valve seat means on its upper face, the circumference of said locking flange containing longitudinal serration means;

an annular groove formed below said locking flange by the cutting shoulder;

a ring of metal composed of chips and metal cut from said cylinder head by the locking flange, tightly compressed into said annular groove locking the valve seat into the cylinder head.

2. The self locking valve insert of claim 1 in which the diameter of said locking flange is not less than 0.005 greater nor more than 0.015 greater than the diameter of the pilot flange.

* * * * *